United States Patent [19]

Nilsson

[11] Patent Number: 4,941,526

[45] Date of Patent: Jul. 17, 1990

[54] DEVICE FOR REGULATION OF THE FLOW OF AN OPERATIVE MEDIUM

[75] Inventor: Hans-Ove Nilsson, KÅllered, Sweden

[73] Assignee: AB Volvo, Goteborg, Sweden

[21] Appl. No.: 146,374

[22] Filed: Feb. 11, 1988

[30] Foreign Application Priority Data

May 15, 1986 [SE] Sweden ..... 8602214

[51] Int. Cl.[5] ..... F28D 15/02

[52] U.S. Cl. ..... 165/32; 165/40; 165/41

[58] Field of Search ..... 165/32, 40, 96

[56] References Cited

U.S. PATENT DOCUMENTS 4,254,820 3/1981 Asselman et al. ..... 165/104.27

FOREIGN PATENT DOCUMENTS 37492 4/1981 Japan ..... 165/32

*Primary Examiner*—Albert W. Davis, Jr.

*Attorney, Agent, or Firm*—Harness, Dickey & Pierce

[57] ABSTRACT

A heat pipe incorporating means for regulating the transfer of heat. The heat pipe consists of a condenser element, an evaporator element and an interconnecting conduit connecting these two elements together. The regulating means consists of a valve body and a valve seat which is fixedly connected to the heat pipe. To control the valve body a means made from a configuration memory alloy is provided, which alloy is arranged to alter its shape upon attainment of a predetermined temperature.

5 Claims, 2 Drawing Sheets

DEVICE FOR REGULATION OF THE FLOW OF AN OPERATIVE MEDIUM

BACKGROUND OF THE INVENTION

The subject invention concerns a device for regulation of the transfer of heat in a heat pipe by means of an operative medium contained in the pipe. The heat pipe is of the kind comprising a heat-emitting condenser element, a heat-absorbing evaporator element and an interconnecting conduit joining said two elements together. The regulator means comprises a valve seat which is formed on the interior face of the heat pipe, and a valve body which cooperates with said valve seat to open and close the valve opening formed between said valve body and said valve seat. A member consisting of a configuration memory alloy is connected to the valve body and is arranged to alter its configuration upon the attainment of a predetermined temperature and in doing so, cause the valve body to open or close the valve opening.

Prior-art heat pipes of this kind suffer from the disadvantage of not being able to provide distinct valve closing and opening positions. One example of a prior-art structure is the device disclosed in U.S. Pat. No. 4,693,306. The device shown therein consists of a pipe which is formed with a valve flange and which is arranged to sealingly seat against an interior annular portion of the condenser element. The valve opening and closing movements are controlled by the expansions and contractions of the pipe forming the valve and by those of the condenser element body, which components are made from materials having different coefficients of thermal expansion. Because of this arrangement, the valve will open and close as the result of thermal variations when one part, the condenser element, expands to a larger extent than the other part, the pipe. However, this arrangement does not provide distinct opening or closing movements and therefore sufficiently accurate control of the thermal flow inside the heat pipe is not possible with this prior-art structure.

Another problem encountered in the structure disclosed in U.S. Pat. No. 4,693,306 is that it calls for very careful and complex manufacturing and assembly procedures if the desired sealing effect is to be obtained between the valve and its associated seat. Since both the valve and the seat are fixedly secured to the condenser element the spatial interrelationship of these components must be absolutely accurate to ensure that the closure of the valve opening occurs at the desired temperature. In this structure, the closing temperature depends entirely on the spacing of the valve from its associate seat under cold conditions. Since comparatively small movements are involved in the process extremely high-precision assembly is required as regards heat pipes of this construction.

SUMMARY OF THE INVENTION

The purpose of the subject invention is to obviate the problems outlined in the aforegoing in a simple and economically favourable manner. This purpose has been achieved by using a means which is made from a configuration memory alloy to cause the valve to open and close. A configuration memory alloy is a metal alloy to which has been imparted the property of "memorizing" two different shapes between which the alloy alternates at a certain temperature. A configuration memory alloy thus is capable of generating a comparatively large and distinct movement in response to the changes of temperature. This is an advantageous feature because it allows control of the opening and closing movements of the valve in a considerably more accurate and precise manner than has hitherto been possible. Because of the comparatively large valve movement, the latter need not necessarily be made use of in its entirety but some of it may be spent to ensure that the valve closes positively at each occurrence. When the configuration memory alloy member is in the form of a helical spring a spring-biased closing movement is obtained with resulting satisfactory valve sealing effect.

BRIEF DESCRIPTION OF THE DRAWINGS

One advantageous embodiment of the invention will be described in closer detail in the following with reference to the accompanying drawings, wherein.

DETAILED DESCRIPTION OF PREFERRED EMBODIMENT

Figure 1:
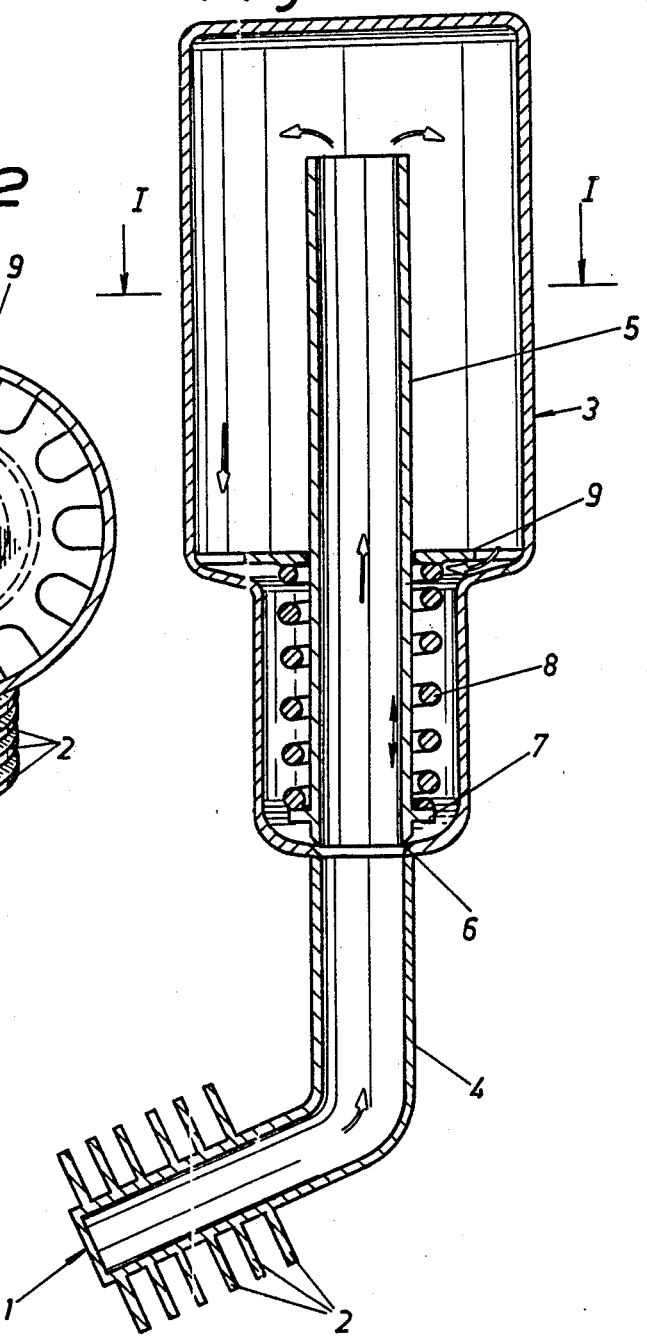
FIG. 1 is a longitudinal sectional view through a heat pipe provided with a regulating device in accordance with the invention.
Figure 2:
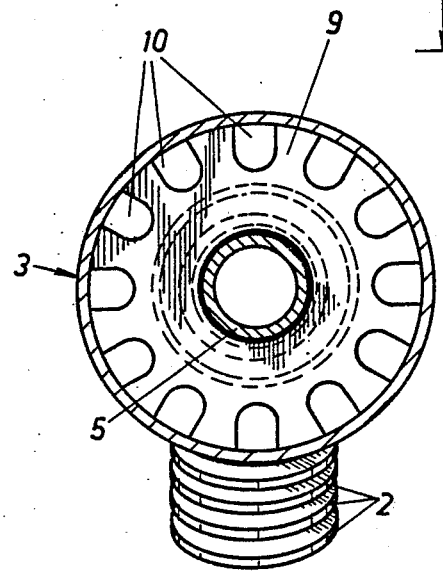
FIG. 2 is a sectional view along line I—I of FIG. 1.

The heat pipe illustrated in FIG. 1 consists of an evaporator element 1 having fins 2 thereon for increased heat absorption, a condenser element 3 and an interconnecting conduit 4 joining the two elements together. The condenser element 3 forms a valve housing enclosing a valve therein. The valve comprises a valve body 5 in the form of a tube, and a valve seat 6 which forms the outlet mouth of the condenser element 3, debouching into the interconnecting conduit 4. The tubular valve body 5 is provided at its lower portion with a sealing surface which is arranged to sealingly abut against the valve seat 6, and it is formed with an upwards open end to allow the operative medium, when in its evaporated state, to pass from the evaporator 1 to the condenser 3. Furthermore, the valve body 5 is provided at its lower end with a transverse flange 7 to the upper face of which is fixedly secured a helical spring 8. The latter is made from a configuration memory alloy having a built-in shape deformation capacity upon attainment of a predetermined temperature. The upper end of the helical spring 8 is fixedly secured to a washer 9 which is in turn fixedly secured to the condenser element 3. The washer 9 is formed around its outer peripheral edge with a number of recesses 10 which are intended to facilitate passage of the condensed operative medium from the upper portion of the condenser element 3 to the lower portion thereof.

Figure 3:
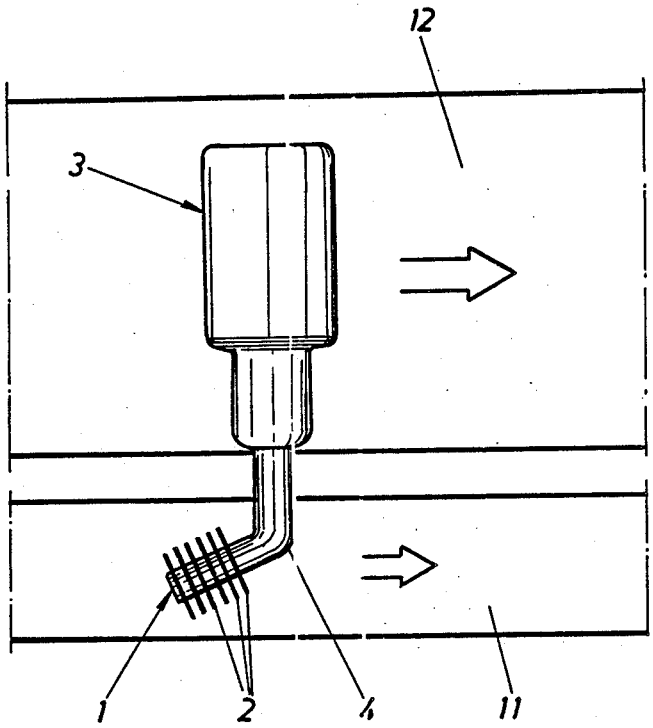
FIG. 3 is a schematical representation of the use of a heat pipe.

A heat pipe of this kind may be used e.g. in a motor vehicle to transport heat, as illustrated in FIG. 3, from a hotter medium, such as the exhaust gases in the exhaust pipe 11 of the motor vehicle, to a cooler medium, such as the cooling water inside the coolant line 12 from the vehicle motor for the purpose of supplying additional heat to the passenger compartment of the vehicle. In this case, the evaporator element 1 of the heat pipe is disposed in the exhaust pipe 12 and the condenser element 3 in the coolant line 12.

The heat pipe operates in the following manner. When the hot exhaust gases flow past the evaporator element 1 the operative medium contained therein in liquid form, usually water, is evaporated and the steam rises through the interconnecting conduit 4 upwards inside the valve body 5 and flows out into the condenser element 3. The steam deposits on the inner faces of the condenser element 3 in the form of condensation and flows through the recesses 10 formed in the washer 9 through the opening gap delimited between the valve seat 6 and the sealing surface of the valve body and along the inner faces of the interconnecting conduit 4 back into the evaporator element 1, where it is again evaporated.

The steam successively heats the condenser element 3 including all its components, such as the helical spring 8 made from a configuration memory alloy. At a certain predetermined temperature the configuration memory alloy of the helical spring 8 will change its shape and will close the valve opening. Since the flow of condensate back to the evaporator ceases, the evaporation, too, will cease. Consequently, the condenser element 3 will become cooler as a result of the cooling effects of the coolant flowing around it. As the temperature of the condenser element goes down, so does the temperature of the configuration memory alloy, and it will reach the temperature level at which is alters its shape. As a result, the helical spring 8 will resume its original configuration and therefore again open the valve opening, allowing liquid to flow down into the evaporator element 1. Thus, the evaporation process therein will resume.

The regulator means in accordance with the invention thus provides automatic control of the evaporation and condensation processes. The regulator device is entirely build into the heat pipe and the latter therefore forms a completely closed body.

Thus, the regulator device in accordance with the invention is used to regulate the thermal flow in the heat pipe in such a manner that the cooler medium, that is, the cooling water, is never heated above the predetermined temperature while the hotter medium, that is the exhaust gases, are not cooled below a predetermined temperature. The regulator device thus prevents free liquid flow from the cooled part of the heat pipe, the condenser element 3, to the heated part of the heat pipe, the evaporator element 1, whereby the contents of operative medium in liquid phase inside the heat pipe is collected in an unheated part of the pipe.

The regulator device may be designed in several other ways than that shown and described. The condensate may be collected elsewhere in the heat pipe than in the location shown. In accordance with the embodiment described in the aforegoing the thermal flow may be regulated in dependence of the temperature of the heated (cooler) medium. It is likewise possible to regulate the thermal flow in dependence of the temperature of the heating (warmer) medium. This is achieved by arranging the valve body 5 and the valve seat 6 in such a way that the configuration memory alloy element will be positioned adjacent the evaporator element 1. The shape of the configuration memory alloy member is not limited to that of a helical spring but could be e.g. a rod or a rail.

What I claim is:

1. A device for regulation of the transfer of heat in a heat pipe means of an operative medium contained therein, said heat pipe comprising a heat-emitting condenser element, a heat-absorbing evaporator element and a continuously open interconnecting conduit joining two elements together for flow of vapor from said evaporator element to said condenser element, return conduit means extending from said condenser element to said evaporator element for return of condensed liquid thereto, said regulator device comprising a valve seat formed in said return conduit and a valve body cooperating with said valve seat to open and close a valve opening formed between said valve body and said valve seat, and a member consisting of a configuration memory alloy in the form of the helical spring surrounding and connected to the valve body and which is arranged to alter its configuration upon the attainment of a predetermined temperature and in doing so, cause the valve body to open or close the valve opening.

2. A device as claimed in claim 1, characterized therein that the lower end of said helical spring (8) is securely attached to the valve body (5) and the upper end of said spring is securely attached to a washer (9) having a through-opening formed therein for extension therethrough of the valve body (5), said washer (9) in turn being securely attached to the inner face of the condenser element (3).

3. A device as claimed in claim 2, characterized therein that the external marginal edge of the washer (9) is formed with a number of recesses (10) allowing condensed operative medium to pass from the upper portion of the condenser element (3) to the lower portion thereof.

4. A device as claimed in claim 3, wherein the return conduit means is formed in part by the opening between the valve element and the valve seat when the valve element is in its opened position.

5. A device for regulation of the transfer of heat in a heat pipe by means of a operative medium contained therein, said heat pipe comprising a heat-emitting condenser element, a heat-absorbing evaporator element and a continuously open interconnecting conduit joining two elements together for flow of vapor from said evaporator element for return of condensed liquid thereto, said regulator device comprising a valve seat formed in said return conduit and a valve body cooperating with said valve seat to open and close a valve opening formed between said valve body and said valve seat, and a member consisting of a configuration memory alloy which is connected to the valve body and which is arranged to alter its configuration upon the attainment of a predetermined temperature and in doing so, cause the valve body to open or close the valve opening, said valve body comprising a tubular member forming in part the continuously open interconnecting conduit and which is surrounded by a valve element that engages said valve seat when in the closed position to close the valve opening.

* * * * *